US006334539B1

(12) United States Patent
Jajko et al.

(10) Patent No.: US 6,334,539 B1
(45) Date of Patent: Jan. 1, 2002

(54) BENDABLE BOOKEND

(75) Inventors: Waldemar A. Jajko, Croydon, PA (US); Marlin J. Hoskinson, Delran; Eugene M. Lorincz, Cinnaminson, both of NJ (US)

(73) Assignee: Moore Push-Pin Company, Wyndmoor, PA (US)

( * ) Notice: Subject to any disclaimer, the term of this patent is extended or adjusted under 35 U.S.C. 154(b) by 0 days.

(21) Appl. No.: 09/506,760

(22) Filed: Feb. 18, 2000

(51) Int. Cl.[7] ..... A47B 65/00

(52) U.S. Cl. ..... 211/42; 211/43; 248/441.1; D19/34.1

(58) Field of Search ..... 211/42–43, 72, 211/10–11, 126.13, 126.16, 184; 248/446, 447.1, 459–460, 441.1, 174, 300; D19/34.1–34.5; D8/323–329

(56) References Cited

U.S. PATENT DOCUMENTS

| | | | | | |
|---|---|---|---|---|---|
| 925,136 | A | * | 6/1909 | Schickerling | 248/441.1 |
| D52,904 | S | * | 1/1919 | Young | D8/323 |
| 1,370,279 | A | | 3/1921 | Burzynski | |
| 1,396,910 | A | * | 11/1921 | Annable | 211/43 |
| D66,398 | S | | 1/1925 | Bowers | |
| 1,598,467 | A | * | 8/1926 | Weeks | 211/42 |
| D73,215 | S | * | 8/1927 | Wessel | D19/34.3 |
| 1,750,576 | A | * | 3/1930 | Cubberley | 211/43 |
| 1,795,526 | A | | 3/1931 | Turner | |
| 2,031,698 | A | * | 2/1936 | Fanzoi | 211/43 |
| 2,151,269 | A | * | 3/1939 | Grant | 211/43 |
| 2,262,240 | A | * | 11/1941 | Koeble | 248/441.1 |
| D135,786 | S | * | 6/1943 | Grivin | D19/34.1 |
| 2,708,085 | A | * | 5/1955 | Bonaccorsi | 248/198 |
| 2,872,046 | A | * | 2/1959 | Polay | 211/42 |
| 3,013,668 | A | * | 12/1961 | Mennen | 211/40 |
| 3,385,450 | A | * | 5/1968 | Nadler et al. | 211/42 |
| 3,604,564 | A | | 9/1971 | Weyll, Jr. | 211/43 |
| 3,833,197 | A | * | 9/1974 | Dyke | 248/441.1 |
| D247,078 | S | | 1/1978 | Grusin | D6/106 |
| 4,105,182 | A | * | 8/1978 | Jacobson | 211/42 |
| 4,192,423 | A | | 3/1980 | Rekow | 206/586 |
| 4,358,019 | A | | 11/1982 | Garner | 211/42 |
| 4,637,632 | A | * | 1/1987 | Rubash et al. | 211/42 |
| D300,639 | S | | 4/1989 | Klodt | D19/34.1 |
| 4,944,413 | A | | 7/1990 | Connell | 211/42 |
| 5,036,988 | A | | 8/1991 | Rouire | 211/42 |
| D326,077 | S | * | 5/1992 | Rana | D19/34.1 |
| 5,183,163 | A | * | 2/1993 | Slaiken | 211/43 |
| D336,106 | S | | 6/1993 | Goodman et al. | D19/34.1 |
| D336,107 | S | | 6/1993 | Goodman et al. | D19/34.1 |
| D341,621 | S | | 11/1993 | Evenson | D19/34.1 |
| 5,405,019 | A | * | 4/1995 | Cross | 211/42 |

* cited by examiner

*Primary Examiner*—Daniel P. Stodola
*Assistant Examiner*—Jennifer E. Novosad
(74) *Attorney, Agent, or Firm*—Woodcock Washburn Kurtz Mackiewicz & Norris LLP

(57) ABSTRACT

A bendable bookend having a first, non-operating position wherein the bendable bookend includes a substantially flat planar piece and a second, operating position wherein the bendable bookend includes a base and a support member extending upwardly from the base. In the non-operating position, the bendable bookend includes a base, a tongue extending from the base in a plane that is coplanar with a plane defined by the base, and a support member extending from the base in a plane that is coplanar with the plane defined by the base and in a direction toward the top end. In the operating position, the formed up bookend includes a base, a tongue, and an upstanding support member. The tongue extends from the base in a plane that is coplanar to a plane define by the base, and the support member extends upwardly from the base. Preferably, the bendable bookend includes a stiffening structure to help strengthen the formed up bookend. In addition, the bendable bookend includes an operating angle formed between tongue and the support member. Preferably, the operating angle is about 90 degrees. The bendable bookend is preferably constructed without any bend or fold lines, or any other weakening of the base metal. A slot may be formed in the support member of the bendable bookend to hang and display the device. A method for manufacturing, packaging, and shipping a bendable bookend as a substantially flat planar piece defining a non-operating position and bending the flat planar piece to form a bookend having a horizontal base and tongue, and an upstanding support member defining an operating position. The method also provides for the storage and display of the bendable bookend.

22 Claims, 8 Drawing Sheets

BENDABLE BOOKEND

FIELD OF THE INVENTION

The present invention relates in general to support mechanisms for supporting items in a generally upright position, and more particularly, the present invention relates to a bendable bookend that is manufactured, shipped, stored, and displayed in a non-operating position as a substantially flat planar piece and that can be bent into an operating position by an end user to form a bookend having a base and a support member extending upwardly therefrom.

BACKGROUND OF THE INVENTION

Many different designs of bookends are available for supporting items, such as books, on a substantially horizontal, planar surface, such as a shelf. One common type includes a single sheet of metal which is cut and bent to form an upstanding plate member, a base, and a tongue extending inwardly, parallel to the flat base. The base and tongue being at a right angle from the plate member so the tongue can lie on the shelf with the plate member standing therefrom. The end of a row of books is then placed upon the tongue and rests against the plate member. Such book ends are often stamped out of flat metal and bent during the manufacturing process to form the base and tongue and the upstanding plate member extending therefrom at a right angle. Since the base and tongue are rigid extensions perpendicular to the vertical side of the book end, such a book end tends to be bulky. These bulky formed-up bookends tend to take up a lot of storage and display space, and increase the volume and thus the cost for packaging and shipping the bookends.

Other known types of bookends include objects having a relatively low center of gravity and that include a flat base and a flat side against which the end book in a series of books is supported. Since this type of bookend does not have a tongue for books to rest upon and hold the bookend in place, such book ends must be of relatively heavy weight to hold books in an upright position. Again, this type of bookend is bulky and tends to take up a lot of storage and display space. In addition, the shape and weight of this type of bookend tend to increase the volume and weight of the bookends and thus the packaging and shipping costs.

Still another type of bookend is a bookend having a base and two or more upstanding plate members extending upward from the base at right angles to the base. For example, a corner type bookend typically includes a base, a side panel extending upward from the base at a right angle, and an end panel also extending upward from the base at a right angle and also at a right angle to the side panel. The end of a row of books is then placed upon the base and rests against the side panel and end panel. Such book ends are often stamped out of flat metal and folded into shape during the manufacturing process. Accordingly, these corner type bookends also tend to be bulky thereby requiring additional storage and display space and having increased packaging and shipping costs.

As can be seen, most conventional metal bookends are manufactured having a horizontal base and a vertical support member, wherein the support member extends upward from the base at a right angle which tends to make conventional bookends bulky. This creates several problems for manufactures and retailers of bookends. For example, bookends typically take up a lot of floor space at the manufacturer's facilities after they are manufactured because of their rigid or formed shape (e.g., an inverted T-shaped body including a flat base with an upwardly extending support member, or alternatively, a corner type bookend). Also, these bulky, formed up bookends also increase shipping and packaging costs because of the increased volume and unused package space resulting again from the rigid shape of the formed bookend. In addition, bookends having a formed shape also take up a lot of storage space at retailers' facilities and are generally not displayed because they occupy too much valuable shelf space.

Some convention bookends are manufactured as flat planar piece and then bend or folded to form a working bookend. In this regard, reference is made to U.S. Pat. No. 4,358,019, "Book End", issued to Garner, which discloses a one piece folding blank foldable to form a book end having side walls and a base of triangular form, the planes of the side walls and base being normal to each other. However, the bookend described and shown in Garner requires a plurality of bends to form the bookend thereby increasing the time and costs for manufacturing the bookend.

Also, Garner also requires that a pre-fold or fold line be formed in the material of the bookend to facilitate bending of the material during the forming process. This is typically of conventional bookends which are typically manufactured having a bend slot, or scoring, along the bend axis for the purpose of weakening the metal in this area to assist in the bending process. This weakening of the metal to facilitate the bending process increases the time and the cost to manufacture the bookend.

In addition, Garner also includes a cooperating interlocking means for releasably mating in the plane of the connection between the two side walls to secure the panels in position. This cooperating interlocking means also increases the time and cost of the manufacturing process.

Another conventional bookend formed by bending is U.S. Pat. No. 5,036,988, entitled "Bookend for Metal Shelves", issued to Rouire. Rouire discloses a bookend for use on a metal shelf that is formed by bending a single sheet of metal to form an upstanding plate and flat tongue so that the tongue can lie on the metal shelf with the plate upstanding. However, in Rouire, the bookend is bent during the manufacturing process and does not have a non-operating position wherein the bookend material is stored, shipped, and displayed as a flat planar piece.

A problem with conventional foldable bookend is that is it is difficult to precisely and accurately fold the bookend to ensure the proper operating angle of the formed bookend. Fold lines or scoring of the base metal is typically performed to assist with the bending and to try and ensure the proper operating angle. However, forming a fold line or scoring the base metal tends to weaken the bookend in this area and can lead to premature or early failure of the bookend. In addition, a pre-fold or fold lines do not ensure that the folded bookend will have proper operating angle.

In addition, neither Garner nor Rouire has any type of stiffening structure or any formable gusset to help strengthen the formed up bookend and to help reinforce the final operating angle of the formed up bookend. Accordingly, these conventional bookends do not provide a means for accurately forming the operating angle of the formed up bookend and may not provide sufficient support throughout the full range of loads that the bookend may encounter.

There is a need, therefore, for an improved bookend for supporting items in a generally upright position on a horizontal surface. In particular, there is a need for a bendable bookend that is manufactured as a substantially flat planar piece so that it can be easily and inexpensively manufactured, stored, shipped, and displayed and that can later be bent to form a functioning formed up bookend that can be easily, precisely, and accurately bent into an operating position and that has sufficient strength and reinforcement to positively support a row of books in a generally upright position.

SUMMARY OF THE INVENTION

The present invention is directed to a bendable bookend for supporting items in a generally upright position on a substantially horizontal, planar surface. The bendable bookend of the present invention is manufactured, shipped, stored, and displayed as a substantially flat planar piece. Once the bendable bookend has been purchased by an end user, it can be bent to form a bookend having a base and an upwardly extending support member.

The bendable bookend of the present invention includes two positions or configurations. In a first non-operating position, the bookend is a substantially flat planar piece. The non-operating position is used for storing, shipping and displaying the bendable bookend. In a second, operating position, the bookend is bent to form a functioning bookend. The formed up or bent bookend includes a base, a tongue, and a support member extending upward from the base. In the operating position, the bendable bookend is used for supporting one or more items on a horizontal surface. Preferably, the base and the tongue engage the horizontal surface and the support member engages and supports one or more items in a generally upstanding position on the horizontal surface.

The bendable bookend in the non-operating position includes a substantially flat planar body. The substantially flat planar body includes a bottom end and a top end, a base, a tongue extending from the base in a direction toward top end, and a support member extending from the base in a direction toward the top end. The tongue and the support member are coplanar with a plane defined by the base. An opening is formed between and separates the support member and the tongue.

The bendable bookend in the operating position includes the base and the tongue extending from the base in a direction toward the top end. The tongue is coplanar with a plane defined by the base, and the base and the tongue are constructed to be in contact with a substantially horizontal surface. The support member extends upward from the base and an operating angle is formed between the tongue and the support member. The support member engages and supports one or more items in a generally upstanding position on the horizontal surface.

In accordance with another aspect of the present invention, the bendable bookend can also include one or more stiffening structures extending from the base into the support member for reinforcing the operating angle of the bookend and for stiffening the bendable bookend in the operating position. Preferably, the one or more stiffening structures include two ribs, wherein each rib is disposed parallel to a side of the bookend.

In one embodiment of the present invention, each of the stiffening structures further comprises an upper rib portion and a lower rib portion. The upper rib portion is formed on the support member and the lower rib portion is formed on the base. The upper rib and the lower rib are formed in-line and parallel to a side of the bookend.

A gap can be formed between each of the upper rib portions and each of the lower rib portions. The gap allows the bendable bookend to be more easily folded from the non-operating position to the operating position and also helps ensure that the final operating angle of the formed up bookend is about 90 degrees.

In accordance with another aspect of the present invention, the upper rib portion includes an angled bottom end and the lower rib portion includes an angled top end. In the operating position, the angled bottom end of the upper rib and the angled top end of the lower rib contact one another to form the operating angle between the tongue and the support member.

Preferably, the angled bottom end of the upper rib forms an angle of about 50 degrees up from the support member and the angled top end of the lower rib forms an angle of about 50 degrees up from the base. This helps ensure that the operating angle of the formed up bookend is about 90 degrees.

One or more formable gussets can be formed by the contact of the angled bottom end of the upper rib and the angled top end of the lower rib. Each gusset provides reinforcement of the operating angle of the formed up bookend.

The bendable bookend includes a bending axis along which the bendable bookend is bent. Preferably, the bend axis does not include a pre-fold, fold lines, scoring, or other weakening of the bookend material.

The bendable bookend is preferably made from a metallic material. The metallic material preferably is a ductile material and also has a memory to maintain its shape once it has been bent into the operating position.

In accordance with another aspect of the present invention, a slot can be formed in the bookend for hanging and displaying the bookend. Preferably, the slot is an elongated slot formed in the support member proximate the top end.

A further embodiment within the scope of the present invention is directed to a method of manufacturing, shipping, storing, and displaying a bendable bookend in a non operating position as a substantially flat planar piece, and then bending the bendable bookend into an operating position as a coplanar base and tongue and an upwardly extending support member for supporting one or more items in a generally upright position on a horizontal surface. The method includes manufacturing a bookend in a non-operating position as a substantially flat planar piece, shipping the flat planar bookend to one of a point of resale and an end-user, and bending the flat planar piece to an operating position wherein the bookend is formed up having a base that is constricted to be disposed on a top surface of a flat surface and a support member extending upward from the base for supporting one or more books, or the like.

The method can also include storing the bendable bookend as the flat planar piece at one of a manufacturer's and a retailer's facility. Also, the method can include displaying the bendable bookend as the flat planar piece for sale to an end user.

Preferably, the method includes manually bending the bookend from the flat planar piece of the non-operating position into the coplanar base and tongue and upstanding support member of the operating position.

In a further embodiment of the present invention, the method includes forming one or more stiffening structures between the base and the support member along each side of the bookend to strengthen the formed up bookend. The method can also include forming one or more formable gussets at a bending axis of the bookend to reinforce an operating angle of the formed up bookend.

According to another aspect of the present invention, the method can include forming each of the stiffening structures as ribs having an angled end proximate the bending axis, wherein the angled ends contact one another in the formed up operating position to define an operating angle between the tongue and the support member. Preferably, the operating angle is formed having an angle of about 90 degrees. Preferably, the angled ends are formed having an angle of about 50 degrees up from a plane defined by the flat planar piece in order to help ensure that the final operating angle is about 90 degrees.

BRIEF DESCRIPTION OF THE DRAWINGS

The foregoing and other aspects of the present invention will become apparent from the following detailed description of the invention when considered in conjunction with the accompanying drawings. For the purpose of illustrating the invention, there is shown in the drawings an embodiment that is presently preferred, it being understood, however, that the invention is not limited to the specific methods and instrumentalities disclosed. In the drawings.

DETAILED DESCRIPTION OF PREFERRED EMBODIMENTS

Figure 1:
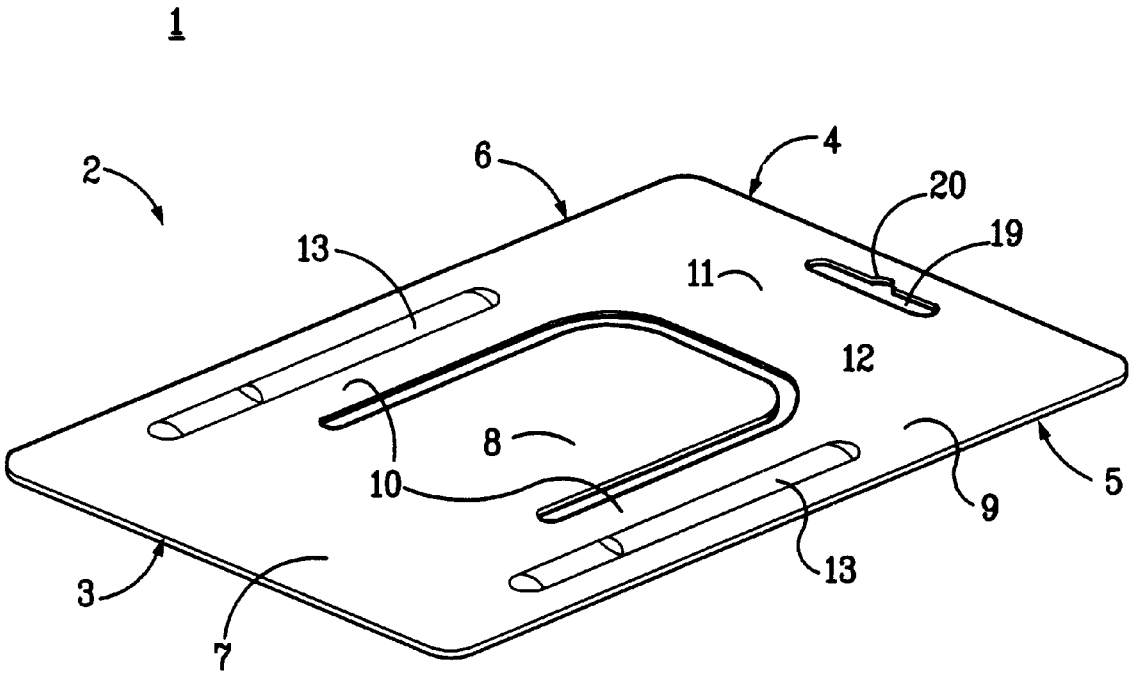
FIG. 1 is a perspective view of an exemplary bendable bookend in a non operating position including a substantially flat planar piece in accordance with the present invention.

The present invention is directed to a bendable bookend for supporting one or more items in a generally upright position on a substantially horizontal, planar surface, such as for example a row of books on a shelf. The bendable bookend has two positions, a first, or non-operating position wherein the bookend is a substantially flat planar piece, and a second, operating position wherein the flat planar body is bent to form a functioning bookend having a substantially horizontal base and tongue, and a support member extending upward therefrom. The bookend is manufactured, shipped, stored, and displayed as a flat planar piece (e.g., in the non-operating position) thereby minimizing the amount of storage and display space required for the bookend. Also, this helps reduce the packaging and transportation/shipping costs for the bookends because the flat planar pieces are not bulky.

Once the flat bookend is purchased by an end-user, the end-user can bend the flat planar piece along a bending axis to form a functioning bookend (e.g., the operating position) wherein the base and tongue are coplanar and the support member extends upward from the base.

FIGS. 1 through 6 show an exemplary bendable bookend in a first, non operating position. As shown, the bendable bookend 1 is constructed originally as a substantially flat planar piece 2 having a bottom end 3, a top end 4, a first or left side 5, and a second or right side 6. Preferably, the corners where the bottom end 3, top end 4, first side 5, and second side 6 meet are formed as rounded or curved corners.

A base 7 is formed proximate the bottom end 3 and a tongue 8 extends from the base 7 in a plane that is coplanar with a plane defined by the base 7 and in a direction toward the top end 4. In the non-operating position, the support member 9 is formed extending from the base 7 in a plane that is coplanar with the plane defined by the base 7 and in a direction toward the top end 4.

Figure 2:
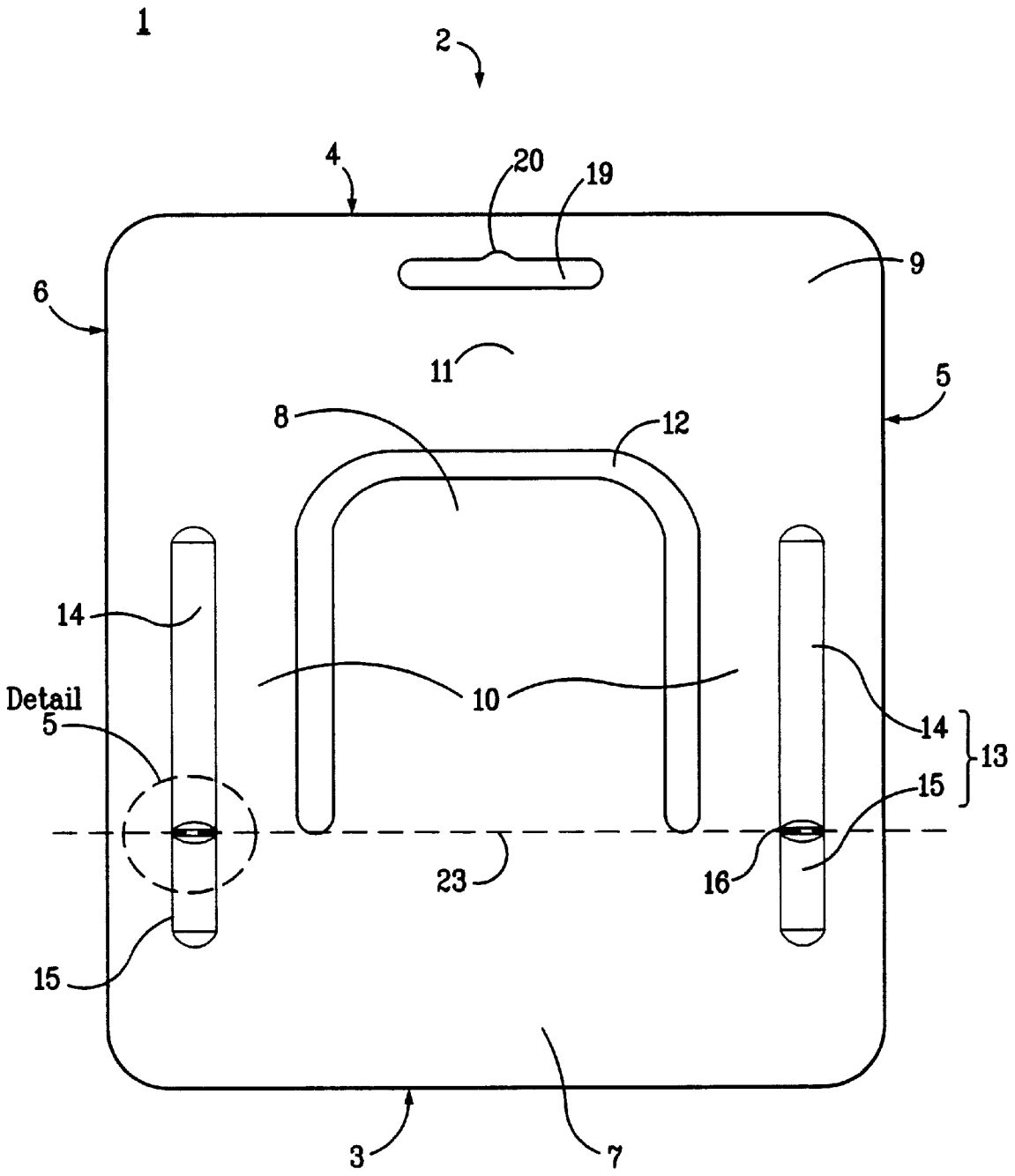
FIG. 2 is a top view of the bendable bookend of FIG. 1.
Figure 3:
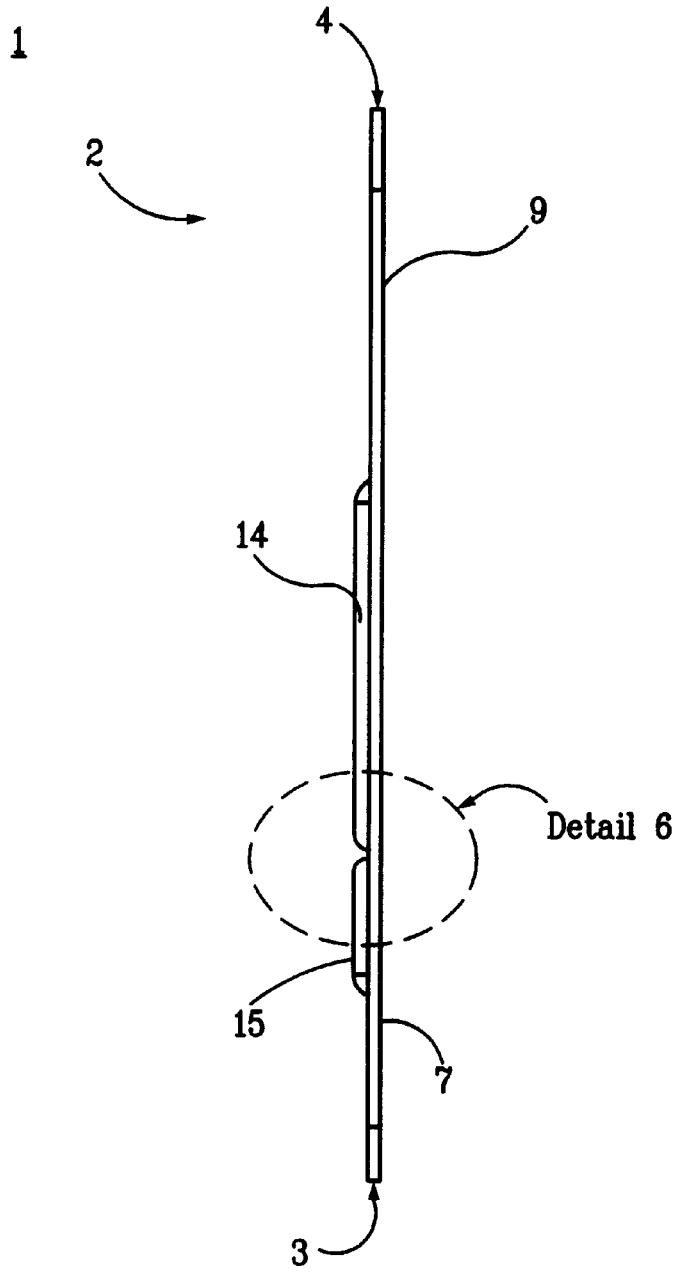
FIG. 3 is a side view of the bendable bookend of FIG. 1.
Figure 4:
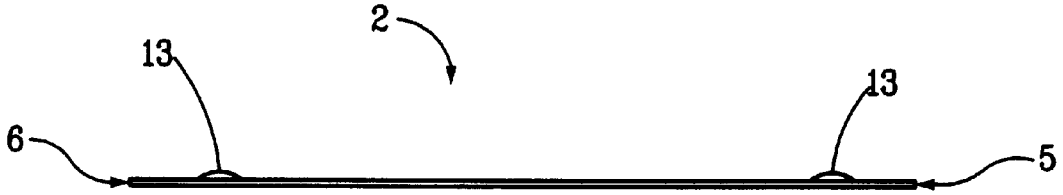
FIG. 4 is an end view of the bendable bookend of FIG. 1.

As shown in FIGS. 1 and 2, the support member 9 includes two support legs 10 connected to and extending from the base 7, and a top portion 11 connecting the two support legs 10 together proximate the top end 4.

An opening 12 is formed between and separates the tongue 8 and the support member 9. As shown, the tongue 8 extends from a center region of the base toward the top end 4 and each support leg 10 extends from a side region of the base toward the top end 4. The opening 12 can be formed using conventional techniques, such as by cutting and/or stamping the flat planar piece 2, to form a generally U-shaped opening 12, as shown in FIG. 2. The opening 12 defines an outer peripheral edge of the tongue 8 and an inner peripheral edge of the support member 9.

One or more stiffening structures 13 are formed between the base 7 and the support member 9 to add strength and stiffen the bendable bookend 1 in its bent or operating position. As shown in FIGS. 1 through 4, there are preferably two stiffening structures 13 formed extending parallel along each side 5, 6 from the base 7 to the support member 9.

As shown, each stiffener structure 13 further includes an upper rib 14 formed on the support member 9 and a lower rib 15 formed on the base 7. Preferably, the upper ribs 14 and the lower ribs 15 are formed as a raised portion having a curved or convex shape when viewed from the top of the substantially flat planar piece 2. The raised ribs 14, 15 can be formed by conventional forming techniques, such as using a male die having a rib formed thereon and a corresponding female punch having a cutout.

Figure 5:
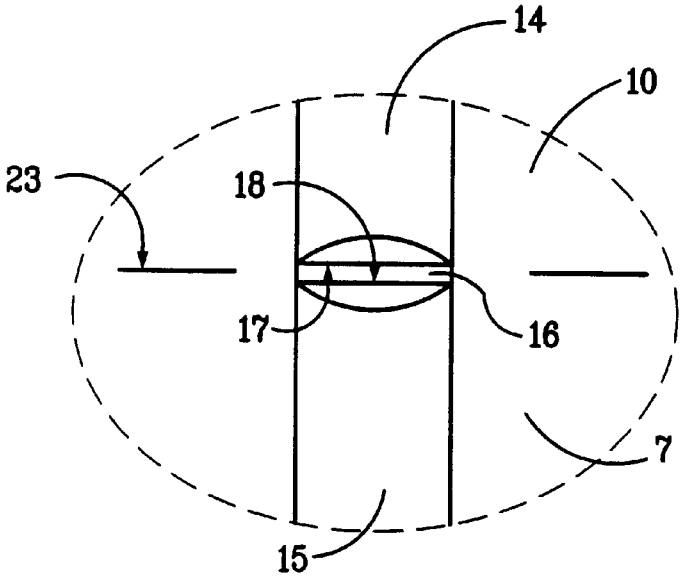
FIG. 5 is a detailed top view of the angle ends of the ribs of the bendable bookend of FIG. 2.
Figure 6:
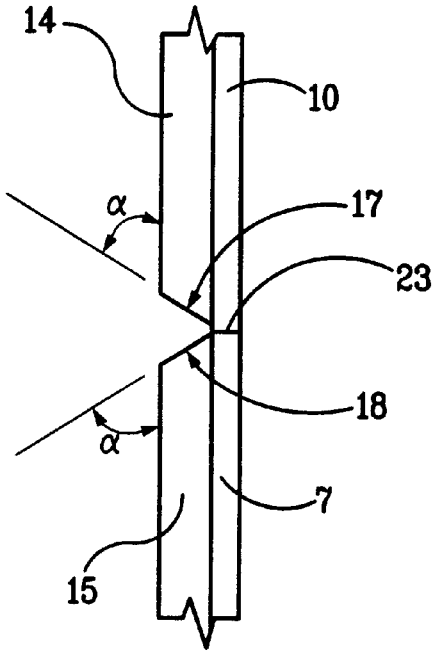
FIG. 6 is a detailed side view of the angle ends of the ribs of the bendable bookend of Figure 3.
Figure 7:
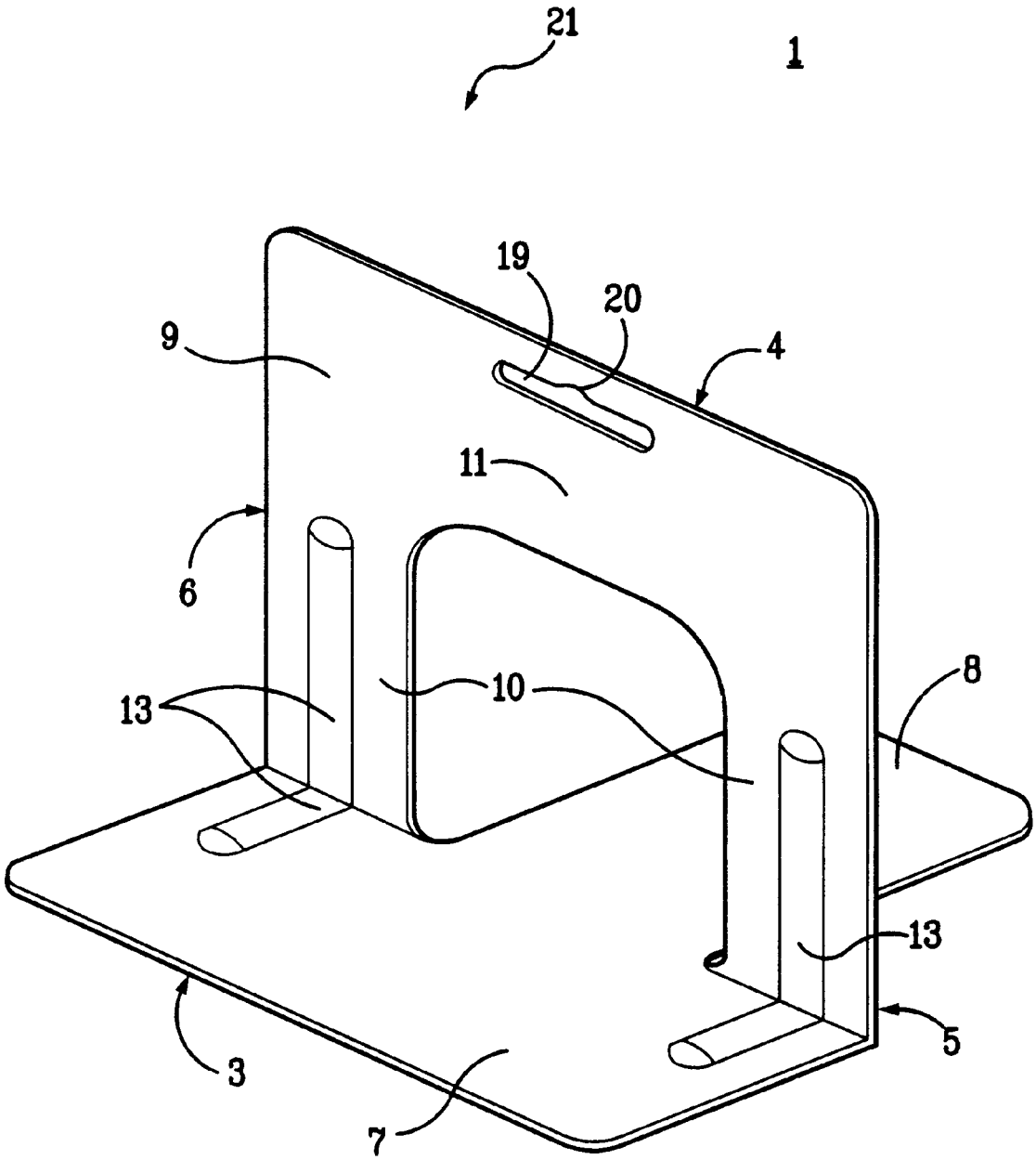
FIG. 7 is a perspective view of the exemplary bendable bookend in an operating position including a base, a tongue, and an upwardly extending support member in accordance with the present invention.
Figure 8:
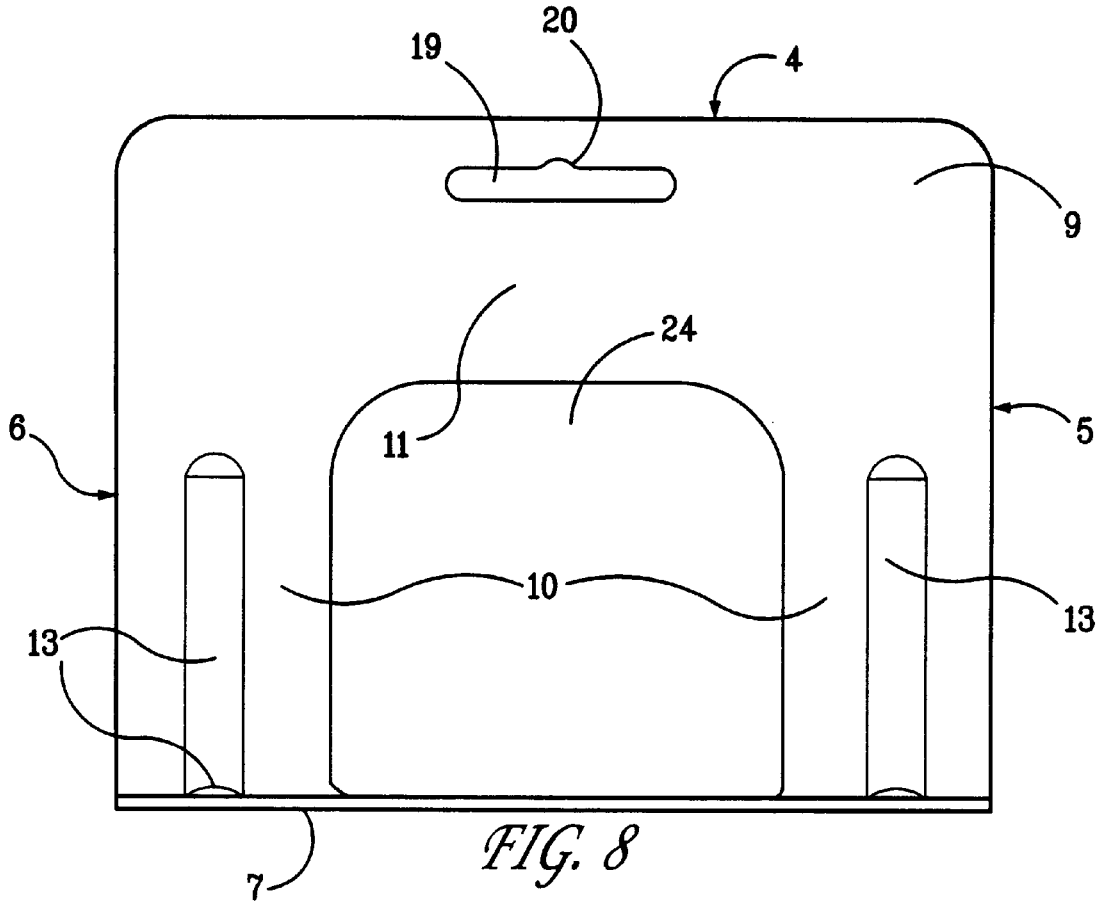
FIG. 8 is an end view of the bendable bookend of FIG. 7.
Figure 9:
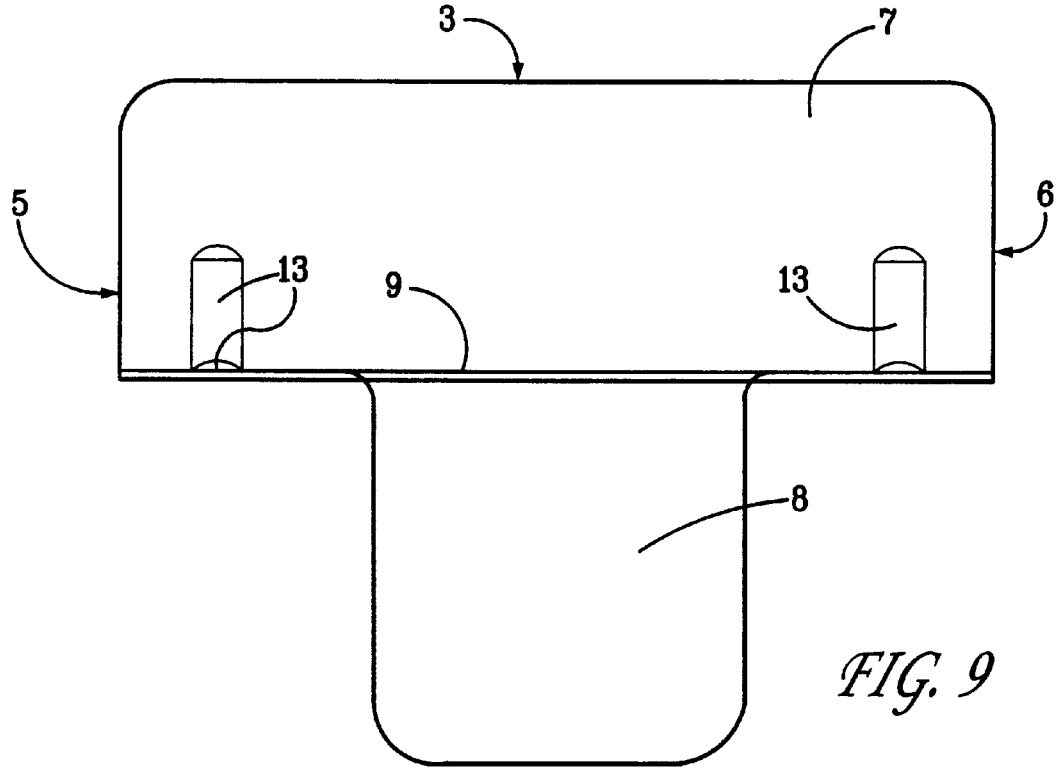
FIG. 9 is a top view of the bendable bookend of FIG. 7.

As shown in FIGS. 5 and 6, a gap 16 can be formed between the upper rib 14 and the lower rib 15. The gap 16 preferably separates the upper rib 14 and the lower rib 15 when the bookend 1 is in the flat planar position. Accordingly, in the non-operating position wherein the bookend is a substantially flat planar piece, the upper and lower ribs do not contact or cooperate with one another. Preferably, the gap 16 is formed as a flat section along and parallel to the bend axis of the flat planar piece 2 and is coplanar with the base 7 and support member 9. The size of the gap 16 depends on the particular application. For example, in one embodiment, a gap of about 0.02 inch is formed between and separates the upper and the lower ribs.

In addition, a lower end 17 of the upper rib 14 and an upper end 18 of the lower rib 15 are each preferably formed having a predetermined angle $\alpha$. Preferably, the angles $\alpha$ are approximately equal and each angle $\alpha$ is greater than about 45 degrees as measured up from the flat planar piece 2. More preferably, lower end 17 of the upper rib 14 and the upper end 18 of the lower rib 15 are each formed having an angle α of about 50 degrees, as shown in FIG. 6. The top end of the upper rib and the lower end of the lower rib are preferably formed as rounded ends. Alternatively, the lower end 17 of the upper rib 14 and the upper end 18 of the lower rib 15 can be formed having different angles (not shown), such that the final operating angle of the formed up bookend is the desired angle.

Referring to FIGS. 1 and 2, the flat planar piece 2 can include a slot or hang hole 19 formed in the support member 9. As shown, the slot 19 is formed in the top connecting portion 11 of the support member 9 proximate the top end 4 and includes an elongated opening having rounded ends and a recess 20 formed proximate the top center region of the slot 19. The slot 19 can include other suitable shapes, including circular, square, oval, rectangular, elliptical, etc. Slot 19 can be used to hang the part in a store display. Preferably, the size and shape of the slot 19 is constructed to cooperate with conventional display devices, such a hooks and the like. For example, a bookend having a slot 19 can be displayed conveniently and without taking up too much shelf space by disposing the slot 19 of a bookend in the non-operating position over a hook mounted on a peg board.

Conventional parts have a hang hole formed in the packaging of the part, and not in the part itself. Accordingly, forming the bendable bookend 1 having a slot, or hang hole, 19 formed in the part itself allows the bendable bookend 1 to be stored and displayed more readily and does not require any packaging or additional material in order to hang and display the bookend 1.

FIGS. 7 through 11 show the exemplary bendable bookend in a second, or operating position. As shown, the bendable bookend 1 has been bent from the flat planar position into the operating position to form a bent or formed up bookend 21. Preferably, the bending is performed by an end-user of the bookend just prior to using the bookend to support one or more books, or the like.

Figure 10:
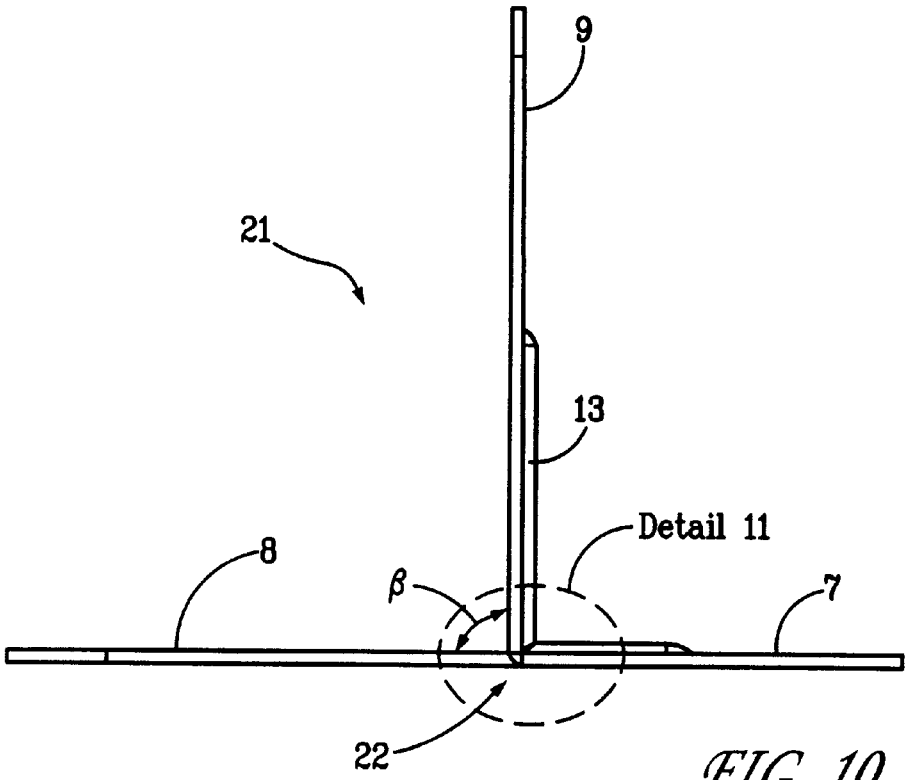
FIG. 10 is a side view of the bendable bookend of FIG. 7.
Figure 11:
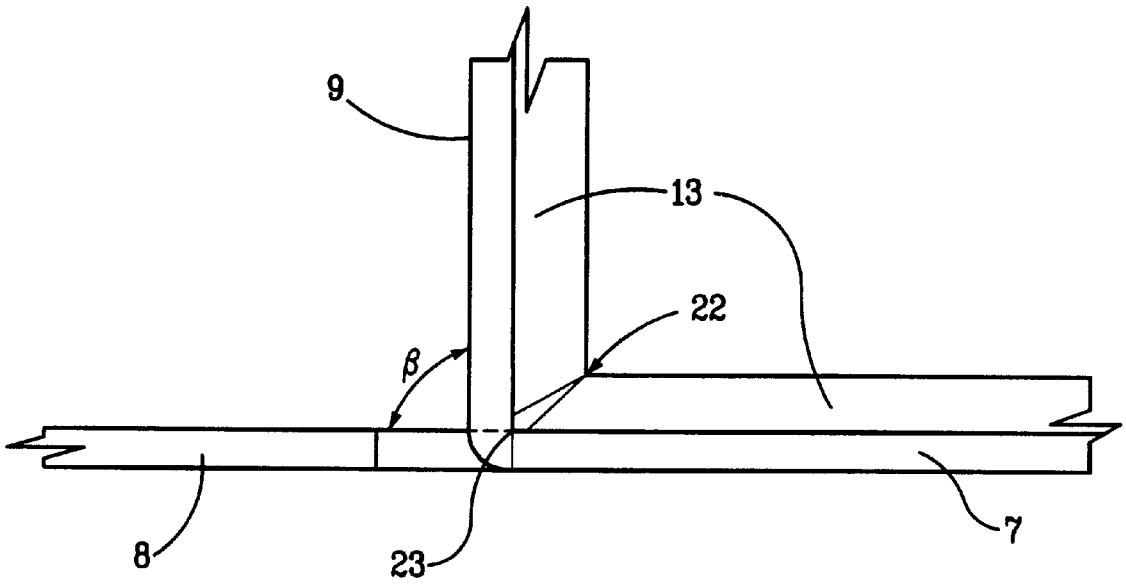
FIG. 11 is a detailed view of the gusset of the bendable bookend of FIG. 10.

A preferred method of bending the bookend can be performed by placing the base 7 portion of the bookend on the edge of a flat surface such that such that the raised ribs of the stiffening structures 13 are facing up and the support member 9 extends out over the edge of the flat surface. The end-user can place one hand on the base 7 and grasp the support member 9 with the other hand. The support member 9 can be bent upwardly until the angled ends of the stiffening structure 13 contact one another, thus forming the operating bookend. Another method of bending the bookend can be performed by manually grasping the top portion 11 of the support member 9 in one hand and the base 7 with the other hand such that the raised ribs of the stiffening structure 13 are facing the person grasping the bendable bookend 1. The bendable bookend 1 can be bent by pushing the center of the bookend outward and away from the person and pulling the bottom end 3 and the top end 4 inward and toward the person. A bending force is applied until the angled ends 17, 18 of the upper ribs 14 and lower raised ribs 15 come into contact with one another, as shown in FIGS. 10 and 11. Other suitable methods can be used to bend the bookend from the flat planar (e.g., non-operating) position to the bent (e.g., operating) position.

As shown in FIGS. 7 through 10, in the operating position, the formed up bookend 21 includes a base 7, a tongue 8, and upwardly extending support member 9. As shown in the Figures, the tongue 8 extends from one side of the base 7 in a plane that is coplanar to a plane define by the base 7, and the support member 9 extends upwardly from the base 7. An opening 24 is formed in the upstanding support member 9 and is defined by an inner peripheral edge of the support member 9 and an edge where the base 7 and the tongue 8 meet.

Preferably, the bendable bookend 1 is formed such that in the flat planar position each angled end 17, 18 has an angle α greater than 45 degrees from the base metal (e.g., from the base 7 and support member 9). This helps ensure that the resulting operating angle β formed between the tongue 8 and the support member 9 is about 90 degrees.

More preferably, each angled end 17, 18 is formed having an angle α of about 50 degrees from the flat planar piece (e.g., the angle formed between the two angled ends is about 80 degrees), as shown in FIG. 6, and the resulting angle βbetween the tongue 8 and the support member 9 in the bent position is about 90 degrees, as shown in FIGS. 10 and 11.

Forming the two angles of the stiffening structures 13 at an angle α greater than 45 degrees from the flat planar piece 2 and providing a gap 16 between the cooperating upper and lower ribs helps ensure that the final angle β between the tongue 8 and the support member 9 will be about 90 degrees.

As shown in FIG. 10, and in more detail in FIG. 11, a formable gusset 22 is formed along the bending axis 23 by each of the stiffening structures 13 once the bendable bookend 1 has been bent into the operating position. The bending axis 23 is formed where the base 7 and the support member 9 meet. The gusset 22 is formed where the upper ribs 14 of the support member 9 contact the lower ribs 15 of the base 7. In the bent, operating position, the angled ends 17,18 of the upper and lower raised ribs 14,15 are in contact with one another and the two angles α define the final operating angle β between the tongue 8 and the support member 9 of the formed up bookend 21.

The formable gussets 22 only exists once the substantially flat planar piece 2 has been bent to form a functioning, formed up bookend 21 in the operating position. In the operating position, the upper and lower ribs 14,15 become one structure and define a common stiffening structure 13 along each side 5, 6 of the formed up bookend 21. The gussets 22 provide reinforce along the bending axis 23 and also help to strengthen the operating angle β of the formed up bookend 21.

Also, the bookend 1 is preferably formed without any pre-fold, bend slot, fold lines, scoring, or any other weakening of the metal along the bend axis 23. By not forming any bend slot or scoring of the base metal of the bendable bookend, the present invention is able to avoid creating any sharp corners and also avoids unnecessarily weakening the base metal. This is contrary to the conventional techniques in which a bend slot or some other type of weakening of the metal is performed to assist in the bending of the support member relative to the base section.

The invention does not contemplate that the bookend be bendable indefinitely between the flat planar position and the bent position. After a certain number of cycles, it is likely that the metal at the bend will fail causing failure or breakage of the bookend. However, by not including a bend slot or scoring, the present invention may provide additional cycles between the non-operating position and the operating position prior to failure of the metal at the bend axis.

The bookend can be made from a ductile material that allows the bendable bookend to act as a living hinge around the bend axis of the bendable bookend. The material and living hinge allows an end-user of the bookend to bend the bookend from the non-operating position to the operating position. In addition, the material of the bookend preferably has a memory such that the material maintains it shape once the bookend has been bent from the non-operating position to the operating position.

Preferably the bookend is made from a metallic material, such as a low carbon steel. Alternatively, the bookend can be made from other standard materials having properties that allow the bookend to be bent from a generally flat planar position to a bent operating position having a substantially horizontal base and tongue and an upwardly extending support member. For example, the bookend can also be made from an aluminum material, a brass material, a metal alloy material, or the like. In addition, the metallic material of the bendable bookend can be pre-painted or coated with a material having, for example, aesthetic or corrosion resistant characteristics.

The bendable bookend 1 is constructed to support various items (not shown) in a generally upright position. The base and tongue are constructed to be placed on a substantially horizontal surface (not shown), such as for example, a book shelf, a desk, or similar flat planar surface. Various items, including for example, books, magazines, folders, paper, CDs, records, tapes, or the like, rest on the tongue and can be held in a generally upright position between the support member of a formed up bendable bookend and a fixed structure, such as a wall, or between two formed up bendable bookends.

Optionally, a non-skid structure (not shown) and a non-scratch structure (not shown) can be disposed on the bottom surface of one or both of the base and the tongue. The non-skid structure preferably provides a sufficient coupling force to prevent the bookend from sliding along the surface of a shelf under a normal load of a row of books or the like. The non-skid structure can include a rubber mat or pad, a magnetic strip, or the like. The no-scratch structure preferably covers a sufficient area such that the metal material of the bendable bookend 1 does not come into contact with the surface of the shelf. The non-scratch structure can include a piece of felt, cloth, rubber, polyurethane foam, or the like, The present invention also includes an improved method for manufacturing, storing, shipping, and displaying a bookend for supporting one or more items, such as a row of books, using a bendable bookend. The improved method of making, storing, shipping, and displaying the bendable bookend includes manufacturing a bookend in a non-operating position as a substantially flat planar piece, shipping the substantially flat planar piece to one of a point of resale and an end-user, and bending the flat planar piece to an operating position wherein a formed up bookend is formed having a base that is constructed to be disposed on a top surface of a flat surface and a support member extending upward from the base for supporting one or more books. Preferably, the method also includes forming a tongue extending coplanar from the base.

The method can include shipping the bendable bookend as a substantially flat planar piece by mail or parcel service with books or the like. This can be used by manufactures, retailers, etc. as part of a promotion or giveaway, wherein a bendable bookend is included with the purchase of a book or the like. For example, a company, like amazon.com, could include a bendable bookend in the flat, non-operating position with every purchase of a particular type or size order.

The method can also include storing the bendable bookend as a substantially flat planar piece at one of a manufacturer's and a retailer's facility. Also, the method can include displaying the bendable bookend as a flat planar piece for sale to an end user. In addition, the method can include manually bending the bookend from the non-operating position as a flat planar piece into the operating position as a functioning, formed up bookend.

The method can include forming one or more stiffening structures between the base and the support member along each side of the bookend to strengthen the formed up bookend. In addition, one or more formable gussets can be formed at the bending axis of the bookend to reinforce an operating angle of the formed up bookend.

Figure 12:
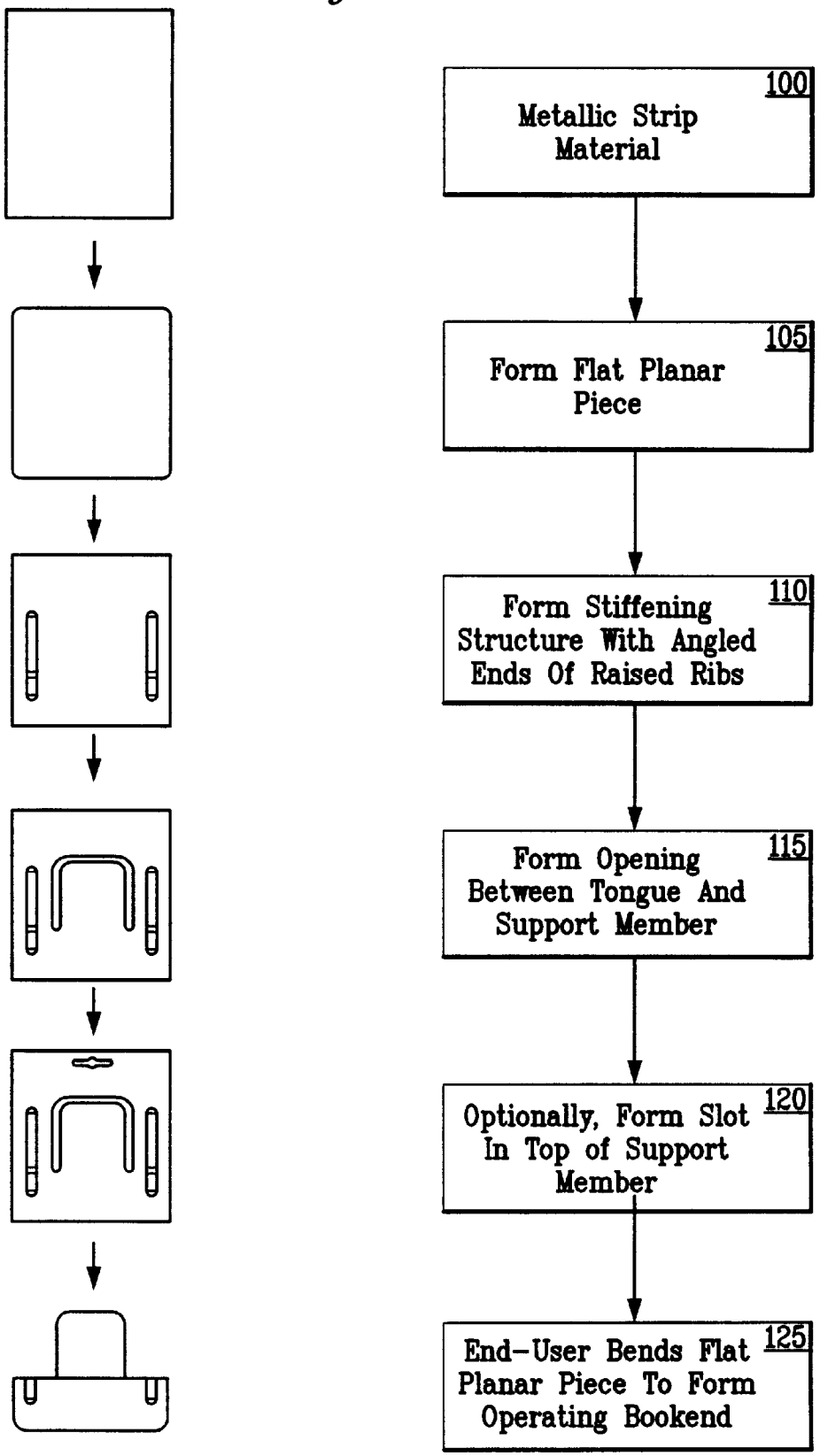
FIG. 12 is a flow chart of an exemplary method of forming a bendable bookend in accordance with the present invention.

FIG. 12 is a flowchart showing an exemplary method for forming a bendable bookend. As shown in FIG. 12, the method can include providing a flat sheet of metal, at step 100. Stamping the flat sheet at step 105 to form a flat planar piece. Preferably, the flat planar piece is formed having curved or rounded corners. Forming a stiffening structure as raised upper ribs in each of the support legs of the support member parallel along the side edges of the flat planar piece, and raised lower ribs in the base, in-line with each of the upper ribs and parallel along the sides of the flat planar piece, at step 110. Also, forming a lower end of each upper rib and an upper end of each lower rib having a predetermined angle of about 50 degrees, at step 110. Forming a substantially U-shaped opening between and separating the tongue and the support member, at step 115. Optionally, forming a slot in the top portion of the support member proximate the top end of the flat planar piece, at step 120. After storing, shipping, and displaying the flat planar piece, bending the bookend from the non-operating position to an operating position by grasping the top end and the bottom end of the flat planar piece and bending the flat planar piece inward toward the center until the angled ends come into contact with one another to form gussets, at step 125. Optionally, affixing a non-skid structure and/or a non-scratch structure to a bottom surface of one or both of the base and the tongue.

Although illustrated and described herein with reference to certain specific embodiments, it will be understood by those skilled in the art that the invention is not limited to the embodiments specifically disclosed herein. Those skilled in the art also will appreciate that many other variations of the specific embodiments described herein are intended to be within the scope of the invention as defined by the following claims.

What is claimed is:

1. A bendable bookend comprising:

a substantially flat planar piece comprising a base, a tongue, and a support member whereby the bookend is bendable between a first non-operating position for storing, shipping and displaying, and a second operating position wherein said support member extends upwards from said base, said base and said tongue are adapted to engage a horizontal surface and said support member is adapted to engage and support at least one item in a generally upstanding position on the horizontal surface; and at least one stiffening structure extending from said base into said support member for reinforcing an operating angle and for stiffening said bookend when in said operating position, wherein said at least one stiffening structure comprises two ribs, and each of said ribs is disposed parallel to a side of said bookend.

2. The bendable bookend of claim 1 wherein when said substantially flat planar piece is in said non-operating position, said tongue and said support member extend from said base in a direction toward a top end of said base, said tongue and said support member being coplanar with a plane defined by said base.

3. The bendable bookend of claim 1, wherein said at least one stiffening structure further comprises an upper rib portion and a lower rib portion, said upper rib portion being formed on said support member and said lower lib portion being formed on said base, wherein said upper rib portion and said lower rib portion are formed in-line and parallel to a side of said bookend.

4. The bendable bookend of claim 3, further comprising a gap formed between each of said upper rib portions and each of said lower rib portions.

5. The bendable bookend of claim 3, wherein said upper rib portion further comprises an angled bottom end and said lower rib portion further comprises an angled top end, wherein said angled bottom end of said upper rib portion and said angled top end of said lower rib portion contact one another in said operating position to form said operating angle between said tongue and said support member.

6. The bendable bookend of claim 5, wherein said angled bottom end of said upper rib portion forms an angle of about 50 degrees up from said support member and said angled top end of said lower rib portion forms an angle of about 50 degrees up from said base.

7. The bendable bookend of claim 5 wherein said operating angle is about 90 degrees.

8. The bendable bookend of claim 5, further comprising one or more formable gussets formed by said contact of said angled bottom end of said upper rib portion and said angled top end of said lower rib portion, each of said gussets providing reinforcement of said operating angle of said formed up bookend.

9. The bendable bookend of claim 1, further comprising a bending axis along which said bendable bookend is bent, wherein said bending axis does not include a pre-fold, fold line, scoring, or weakening of said flat planar piece.

10. The bendable bookend of claim 1, wherein said bendable bookend comprises a metallic material, said metallic material being a ductile material and also having a memory to maintain its shape.

11. The bendable bookend of claim 1, further comprising a slot formed in said bookend for displaying said bendable bookend when said bendable bookend is in said non-operating position.

12. The bendable bookend of claim 11, wherein said slot comprises an elongated slot formed in said support member proximate said top end.

13. The bendable bookend of claim 1 wherein said operating angle is formed between said tongue and said support member when said bookend is in said operating position.

14. The bendable bookend of claim 1 further comprising an opening formed between and separating said support member and said tongue.

15. A method of use for a bendable bookend comprising the steps of:

manufacturing said bendable bookend comprising a substantially flat planar piece having a base, a tongue, and a support member defining a non-operating position;

forming at least one stiffening structure, comprising two ribs, between said base and said support member and along at least one side of said bookend to strengthen said bookend;

shipping said bookend to one of a point of resale and an end-user in said non-operating position; and bending said bookend into an operating position such that said base and said tongue define a plane that can be disposed on a top surface of a flat support surface and said support member can extend upwards from said base for supporting at least one item in a generally upstanding position on the surface.

16. The method according to claim 15, further comprising storing said bendable bookend as said flat planar piece at one of a manufacturer's and a retailer's facility.

17. The method according to claim 15, further comprising displaying said bendable bookend as said flat planar piece for sale to an end user.

18. The method according to claim 15, further comprising manually bending said bookend from said flat planar piece into said operating position.

19. The method according to claim 15, further comprising forming at least one formable gussets at a bending axis of said bookend to reinforce an operating angle of said bookend.

20. The method according to claim 15, further comprising forming at least one upper rib portion and at least one lower rib portion, each having an angled end proximate the bending axis, wherein said angled ends contact one another in said operating position to define an operating angle between said tongue and said support member, wherein said operating angle is formed having an angle of about 90 degrees.

21. The method according to claim 20, further comprising forming said angled ends having an angle of about 50 degrees up from a plane defined by said flat planar piece.

22. The method according to claim 15, wherein said step of forming said at least one stiffening structure further comprises the step of forming at least one lower rib portion on said base and at least one upper rib portion on said support member, wherein said at least one lower rib portion and said at least one upper rib portion are aligned between said base and said support member and contact one another in said operating position.

* * * * *

UNITED STATES PATENT AND TRADEMARK OFFICE

CERTIFICATE OF CORRECTION

PATENT NO. : 6,334,539 B1
DATED : January 1, 2002
INVENTOR(S) : Jajko et al.

It is certified that error appears in the above-identified patent and that said Letters Patent is hereby corrected as shown below:

Title page,
References Cited, (under Bowers), please delete "1/1925" and insert therefor -- 3/1923 --;
References Cited, (under Turner), please delete "3/1931" and insert therefor -- 12/1929 --;

Column 4,
Line 48, please delete "constricted" and insert therefor -- constructed --;

Column 9,
Line 34, please delete "no scratch" and insert therefor -- non scratch --;

Column 11,
Line 4, please delete "lib" and insert therefor -- rib --;

Signed and Sealed this

Thirtieth Day of April, 2002

*Attest:*

*Attesting Officer*

JAMES E. ROGAN
*Director of the United States Patent and Trademark Office*